US006524403B1

(12) United States Patent
Bartlett et al.

(10) Patent No.: US 6,524,403 B1
(45) Date of Patent: Feb. 25, 2003

(54) NON-CHROME PASSIVATION PROCESS FOR ZINC AND ZINC ALLOYS

(76) Inventors: Ian Bartlett, 11 Chanston Avenue Kings Heath, Birmingham (GB), B145BD; Ernest Long, 18 Watson Road Chapelfields, Coventry (GB), CV58EW; Anthony Rowan, 60 Park View Sharnford, Leicestershire (GB), LE103PCT ( * ) Notice: Subject to any disclaimer, the term of this patent is extended or adjusted under 35 U.S.C. 154(b) by 0 days.

(21) Appl. No.: 09/938,234

(22) Filed: Aug. 23, 2001

(51) Int. Cl.[7] ..... C23C 22/48

(52) U.S. Cl. ..... 148/247; 148/283; 106/14.21; 252/187.2; 252/387; 252/182.33

(58) Field of Search ..... 148/273, 247, 148/283; 106/14.21; 252/187.2, 387, 182.33

(56) References Cited

U.S. PATENT DOCUMENTS 5,342,456 A 8/1994 Dolan
5,380,374 A 1/1995 Tomlinson
5,449,414 A 9/1995 Dolan
5,584,946 A 12/1996 Karmaschek et al.
5,603,754 A * 2/1997 Aoki et al. ..... 106/14.12
5,728,233 A 3/1998 Ikeda et al.
5,743,971 A * 4/1998 Inoue et al. ..... 148/247
5,759,244 A 6/1998 Tomlinson
5,897,716 A * 4/1999 Reghi et al. ..... 148/247
5,938,861 A 8/1999 Inoue et al.
5,951,747 A 9/1999 Lewis et al.
5,952,049 A 9/1999 Tomlinson
6,059,867 A 5/2000 Lewis et al.
6,083,309 A 7/2000 Tomlinson
6,206,982 B1 3/2001 Hughes et al.
6,217,674 B1 4/2001 Gray et al.

* cited by examiner

*Primary Examiner*—John Sheehan
*Assistant Examiner*—Andrew L. Oltmans
(74) *Attorney, Agent, or Firm*—Carmody & Torrance LLP

(57) ABSTRACT

A non-chrome containing composition and process are disclosed for enhancing the corrosion resistance of zinc or zinc alloy surfaces. The composition comprises a source of titanium ions or titanates, an oxidant and fluorides or complex fluorides. The composition also preferably comprises an organic acid and/or a Group II metal compound, preferably a Group II metal chloride.

18 Claims, No Drawings

NON-CHROME PASSIVATION PROCESS FOR ZINC AND ZINC ALLOYS

BACKGROUND OF THE INVENTION

The automotive industry has for many years utilized zinc plated components. Chromating of zinc deposits is a common way of delaying the appearance of white corrosion products on these components in service. The two most common chromate finishes are transparent "blue" and "iridescent yellow" films (although black and green variations are also well known). More recently, zinc alloys have been introduced and these give improved resistance to the formation of white corrosion products when used in combination with chromating treatments. However, hexavalent chromium is a toxic and carcinogenic substance. This material can "leach" from chromated zinc deposits and cause damage to the environment and people who regularly handle chromated components. Because of this, there is a requirement to find a suitable alternative. Chromate treatments are an extremely cost effective and efficient way to improve the corrosion performance of zinc and zinc alloy coated components. Any suitable replacement would have to be cost effective, simple to use and be easy to effluent treat and maintain.

U.S. Pat. Nos. 5,380,374; 5,952,049; and 6,038,309 disclose the use of acidic solutions containing group IV metal compounds, including titanium, with oxyanions in the absence of fluoride ions for forming conversion coatings on aluminum and its alloys, magnesium and ferrous metals. U.S. Pat. Nos. 6,059,867; 5,951,747; 5,728,233; and 5,584,946 disclose the use of acidic solutions containing group IV metal compounds, including titanium, in conjunction with phosphate and related ions for forming conversion coatings on aluminum and its alloys. U.S. Pat. No. 6,206,982 discloses a method for forming conversion coatings on aluminum using rare earth elements such as cerium. These inventions are typically used to produce an adherent undercoat which will provide good adhesion to paint. The above inventions are generally not suitable for electroplated zinc or zinc alloy deposits where the cosmetic appearance and corrosion protection are particularly important.

There are relatively few examples of chromium free conversion coatings on zinc and its alloys. U.S. Pat. Nos. 5,938,861 and 5,743,971 disclose the use of solutions containing an oxidizing agent, silicate ions or silicon dioxide and a metal selected from the group Ti, Zr, Ce, Sr, V, W and Mo. The pH of the solutions disclosed in this invention are in the acid region (between pH 0.5–6.0). At this pH, silicate ions are not stable and tend to fall out of solution as silicic acid. Likewise, dispersions of silicon dioxide are not stable and tend to coagulate.

U.S. Pat. Nos. 6,217,674; 5,449,414; and 5,342,456 disclose the use of group IV metal compounds in water soluble organic polymer dispersions. These compositions are applied to metal articles by dip or spray techniques. Organic polymer coatings applied in this way tend to be uneven and for many commercial applications this is undesirable.

It is an object of the invention described herein to provide a "chrome free" process which is capable of producing blue or iridescent coatings on zinc and zinc alloy deposits which give excellent salt spray resistance. The process described is inexpensive, the waste solution is easily treated and the process is simple to operate and maintain.

SUMMARY OF THE INVENTION

We have discovered that attractive conversion coatings with good salt spray resistance can be obtained from aqueous acidic solutions comprising:

1. A source of titanium or titanate ions;
2. An oxidant selected from the group consisting of hydrogen peroxide, compounds other than hydrogen peroxide that dissociate in aqueous solution to form $O^{2-}$, nitrates, and mixtures of the foregoing; and
3. A complexing agent selected from the group consisting of fluorides, complex fluorides, organic acids and mixtures of the foregoing.

It has surprisingly been found that the composition and process of this invention produces blue or iridescent coatings on zinc and zinc alloy deposits and provides the treated articles with enhanced corrosion protection.

DETAILED DESCRIPTION OF THE INVENTION

A process for producing conversion coatings on zinc and/or zinc alloy surfaces is proposed which comprises contacting such surfaces with a composition comprising:

a). a source of ions comprising titanium;

b). an oxidant, preferably selected from the group consisting of hydrogen peroxide, sodium persulfate, ammonium persulfate, nitrates and mixtures of the foregoing; and c). a complexing agent for the ions comprising titanium, preferably selected from the group consisting of fluoride, complexed fluorides, organic acids and mixtures of the foregoing.

The foregoing composition is preferably aqueous and acidic.

The source of ions comprising titanium can be a source of titanium ions themselves, or it can be a source of complexed titanium ions such as titanates. Preferably the source of ions comprising titanium is selected from the group consisting of titanium trichloride, sodium hexafluorotitanate, potassium hexafluorotitanate, and mixtures of the foregoing. The concentration of titanium, as titanium, in the composition may range from 0.01 to 5 g/l but is preferably from 0.05 to 0.2 g/l.

The oxidant is preferably selected from the group consisting of hydrogen peroxide, sodium persulfate, ammonium persulfate, nitrates and mixtures of the foregoing. Most importantly the oxidant must be a compound that dissociates and supplies $O^{2-}$ in aqueous solution. Most preferably the oxidant is hydrogen peroxide. If nitrates are used, they are preferably selected from the group consisting of nitric acid, sodium nitrate, potassium nitrate, group II metal nitrates, titanium nitrate and mixtures of the foregoing. If nitrates are used, they are preferably present in the composition in an amount from 0.1 to 50 g/l, more preferably from 5 to 20 g/l. However, as noted the most preferable oxidizer is hydrogen peroxide preferably at concentrations from 0.1 to 20 g/l, more preferably from 0.5 to 4 g/l.

The composition also comprises complexing agents or anions (collectively "complexing agents") which are sufficient to maintain the ions comprising titanium in solution over an extended period of time. Suitable complexing agents include fluorides, complexed fluorides, organic acids, amino acids and salts of the foregoing such as hydrofluoric acid, sodium fluoride, potassium fluoride, ammonium bifluoride, sodium or potassium bifluoride, fluoroboric acid, fluorosilicic acid, sodium or potassium fluoroborate, sodium or potassium fluorosilicate, oxalic acid, malonic acid, succinic acid, tartaric acid, citric acid, malic acid, maleic acid, gluconic acid, heptonic acid, glycine, aspartic acid, sodium or potassium or ammonium salts of the foregoing acids, and mixtures of the foregoing. When fluoride ions are used they are preferably present in the composition in an amount of from about 0.01 to 4.0 g/l and more preferably from about 0.1 to 0.5 g/l. When complex fluorides are used they are preferably present in an amount from about 0.1 to 40 g/l and more preferably from 1.0 to 15.0 g/l. Organic acids are preferably used at concentrations from about 0.1 to 10 g/l and amino acids are preferably used in the range of from 0.1 to 10 g/l. When combinations of the foregoing compounds are used then the concentrations of each in the combination may be adjusted accordingly. Most preferably, organic acid and/or amino acids are used in combination with fluorides or complexed fluorides. Most preferably, the composition does not contain silicates or silicon dioxide, since at the operating pH of the composition, the foregoing materials are not stable.

In addition to the foregoing ingredients, preferably Group II metal compounds (most preferably chlorides) are added to the composition. These additives have been found to further improve the cosmetic appearance and corrosion resistance of the resultant conversion coating. Most preferably these additives are selected from the group consisting of calcium chloride, strontium chloride, barium chloride and mixtures of the foregoing. The concentration of these additives in the composition may range from about 0.1 to 10 g/l but is preferably from about 0.5 to 2.0 g/l.

Preferably the pH of the composition is maintained between about 1 and 3.5. When using the composition to treat parts, it is preferably maintained at temperatures between about 15 and 70 degrees celsius, preferably between about 20 and 65 degrees celsius. The lower end of the temperature range is used to produce blue passivation coatings, and the higher end of the range to produce iridescent coatings having a higher coating resistance.

The most preferred method of applying the composition is by immersing the parts to be treated in the composition. However, other methods of contact such as spray or conveyorized flood are acceptable. Contact time between the composition and the parts to be treated may range from about 10 seconds to 5 minutes. The treated parts are removed from the composition, rinsed with water, then dried.

Additional topcoats such as silicates or organic lacquers may be applied in order to further enhance the appearance and/or corrosion resistance of the parts. These additional top coats and their application are generally known in the art.

This invention is further demonstrated by the following examples, which should be taken as illustrative only and not limiting in any manner.

EXAMPLE 1

A solution consisting of:

| | |
|---|---|
| A solution of 10% by weight $TiCl_3$ in 20–30% by weight HCI | 2 g/l |
| 35% $H_2O_2$ | 3 g/l |
| NaF | 0.2 g/l |
| DI Water | to 1 litre |

was stirred together and the pH was corrected to 2.0 with 10% sodium hydroxide.

A steel panel coated with 8 microns of zinc was immersed in the solution for 1 minute at 25 deg C., rinsed then dried. A uniform clear to blue conversion coating was formed.

The corrosion resistance of the conversion coating was assessed by examining the time taken for white corrosion products to form in a neutral salt spray chamber (in accordance with ASTM B-117). The panel achieved 12 hours to the first signs of white corrosion.

EXAMPLE 2

A solution consisting of:

| | |
|---|---|
| A solution of 10% by weight $TiCl_3$ in 20–30% by weight HCI | 2 g/l |
| 35% $H_2O_2$ | 3 g/l |
| $NaBF_4$ | 5 g/l |
| DI Water | to 1 litre |

Was stirred together and the pH was corrected to 2.0 with 10% sodium hydroxide.

A steel panel coated with 8 microns of zinc was immersed in the solution for 1 minute at 25 deg C., rinsed then dried. An attractive blue conversion coating was formed.

EXAMPLE 3

A solution consisting of:

| | |
|---|---|
| A solution of 10% by weight $TiCl_3$ in 20–30% by weight HCI | 2 g/l |
| 35% $H_2O_2$ | 3 g/l |
| $NaBF_4$ | 5 g/l |
| $SrCl_2$ $6H_2O$ | 1 g/l |
| DI Water | to 1 litre |

was stirred together and the pH was corrected to 2.0 with 10% sodium hydroxide.

A steel panel coated with 8 microns of zinc was immersed in the solution for 1 minute at 25 deg C., rinsed then dried. An attractive blue conversion coating was formed.

Under corrosion testing the panel achieved 24 hours to the sign of first white corrosion. This result was found to be comparable to blue conversion coatings formed from chromium based products.

EXAMPLE 4

A solution consisting of:

| | |
|---|---|
| A solution of 10% by weight $TiCl_3$ in 20–30% by weight HCl | 2 g/l |
| 35% $H_2O_2$ | 3 g/l |
| $H_2SiF_6$ | 1 g/l |
| DI Water | to 1 litre |

was stirred together and the pH was corrected to 2.0 with 10% sodium hydroxide.

A steel panel coated with 8 microns of zinc was immersed in the solution for 1 minute at 25 deg C., rinsed then dried. A clear conversion coating was formed.

EXAMPLE 5

A solution consisting of:

| | |
|---|---|
| A solution of 10% by weight $TiCl_3$ in 20–30% by weight HCl | 1 g/l |
| $NaNO_3$ | 10 g/l |
| $NaBF_4$ | 2.5 g/l |
| DI Water | to 1 litre |

was stirred together, resulting in a colourless solution. The pH was corrected to 1.8 with 10% nitric acid.

A steel panel coated with 8 microns of zinc was immersed in the solution for 40 seconds at 25 deg C., rinsed then dried. A blue conversion coating was formed.

Under corrosion testing the panel achieved 2 hours to the sign of first white corrosion.

EXAMPLE 6

A steel panel plated with 8 microns of zinc was immersed for 1 minute in a solution at 25 deg C., consisting of:

| | |
|---|---|
| A solution of 10% by weight $TiCl_3$ in 20–30% by weight HCl | 2 g/l |
| $NaNO_3$ | 10 g/l |
| $NaBF_4$ | 5 g/l |
| DI Water | to 1 litre |
| PH corrcted to pH 1.6 with 10% nitric acid. | |

The resulting panel had an attractive uniform iridescent pink/yellow finish. Under corrosion testing the panel achieved 24 hours to the sign of first white corrosion.

EXAMPLE 7

A solution consisting of:

| | |
|---|---|
| A solution of 10% by weight $TiCl_3$ in 20–30% by weight HCI | 4 g/l |
| 35% $H_2O_2$ | 6 g/l |
| Oxalic acid | 2 g/l |
| DI Water | to 1 litre |

was stirred together to dissolve the additives and the pH was corrected to 2.0 with 10% sodium hydroxide.

A steel panel coated with 8 microns of zinc was immersed in the solution for 90 sec at 25 deg C. A uniform pale yellow iridescent conversion coating formed on the panel.

EXAMPLE 8

A steel panel coated with 8 microns of zinc was immersed for 1 minute into the solution described in example 4 at an operating temperature of 55 deg C. The panel was rinsed in DI water and dried, giving a conversion coating with an attractive transparent light pink/green iridescent appearance.

The corrosion performance was found to be 48 hours to the first signs of white corrosion. However, a precipitate formed in the solution after a period of use (ca. 48 hours). Without wishing to be bound by theory, it appears that a further reaction occurs forming titanium dioxide, which is insoluble in water.

EXAMPLE 9

A steel panel plated with 8 microns of zinc was immersed for 1 minute in a solution at 55 deg C., consisting of:

| | |
|---|---|
| A solution of 10% by weight $TiCl_3$ in 20–30% by weight HCl | 4 g/l |
| 35% $H_2O_2$ | 6 g/l |
| Succinic acid | 1 g/l |
| $H_2SiF_6$ | 10 g/l |
| DI Water | to 1 litre |
| PH corrected to pH 2.0 with 10% sodium hydroxide. | |

The resulting panel had an iridescent pink/blue finish. Under corrosion testing the panel achieved 120 hours to the sign of first white corrosion. No precipitate formed in the solution during extended testing.

EXAMPLE 10

A steel panel plated with 8 microns of zinc was immersed for 1 minute in a solution at 55 deg C., consisting of:

| | |
|---|---|
| A solution of 10% by weight $TiCl_3$ in 20–30% by weight HCl | 4 g/l |
| 35% $H_2O_2$ | 6 g/l |
| Succinic acid | 1 g/l |
| $H_2SiF_6$ | 10 g/l |
| $SrCl_2$ $6H_2O$ | 1 g/l |
| DI Water | to 1 litre |
| PH corrected to pH 2.0 with 10% sodium hydroxide. | |

The resulting panel had an iridescent pink/blue finish. Under corrosion testing the panel achieved an excellent 192 hours to the sign of first white corrosion.

The corrosion resistance of the coating was also assessed using Electrochemical Impedance Spectroscopy (EIS). The charge transfer resistance of the coating was found to be about 10 Kohms $cm^2$ after 4 hours immersion in 5% sodium chloride solution. Whereas, the freshly plated zinc surface had a charge transfer resistance of just 200 ohms $cm^2$. This result compares favorably with a conventional iridescent hexavalent chromium conversion coating which has a charge transfer in the region of 15 Kohms $cm^2$ after 4 hours in 5% sodium chloride solution.

The composition of the conversion coating was partially determined by an EDXA measurement on a SEM instrument. Peaks for both Titanium and Strontium were found in an approximate ratio of 5:1. The conversion coating is likely to be composed of titanates and strontium titanates.

Comparative Example 1

A solution consisting of:

| | |
|---|---|
| A solution of 10% by weight $TiCl_3$ in 20–30% by weight HCI | 2 g/l |
| 35% $H_2O_2$ | 3 g/l |
| DI Water | to 1 litre |

was stirred together and the pH was corrected to 2.0 with 10% sodium hydroxide.

A steel panel coated with 8 microns of zinc was immersed in the solution for 1 minute at 25 deg C., rinsed then dried. A patchy non-uniform film was observed. The coating achieved less than 1 hour to the first sign of white corrosion under testing.

A white precipitate formed in the solution after several hours.

Comparative Example 2

A solution consisting of:

| | |
|---|---|
| A solution of 10% by weight $TiCl_3$ in 20–30% by weight HCI | 2 g/l |
| $NaBF_4$ | 5 g/l |
| DI Water | to 1 litre |

was stirred together and the pH was corrected to 2.0 with 10% sodium hydroxide.

A steel panel coated with 8 microns of zinc was immersed in the solution for 1 minute at 25 deg C., rinsed then dried. A patchy non-uniform film was observed. The coating achieved less than 1 hour to the first sign of white corrosion under testing.

What is claimed is:

1. A process for improving the corrosion resistance of a surface comprising zinc or zinc alloys, said process comprising contacting said surface with a composition comprising:

a) a material selected from the group consisting of sources of titanium ions, titanates, and mixtures of the foregoing;

b) an oxidant selected from the group consisting of hydrogen peroxide, persulfates, nitrates and mixtures of the foregoing;

c) a complexing agent selected from the group consisting of fluorides, borofluorides, bifluorides, fluoroborates, fluorosilicates, and combinations of the foregoing; and d) a compound selected from the group consisting of Group II metal compounds;

wherein said composition is substantially free of silicates and silicon dioxide.

2. A process according to claim 1 wherein the oxidant is hydrogen peroxide.

3. A process according to claim 1 wherein the composition also comprises an organic acid.

4. A process according to claim 1 wherein the Group II metal compound is selected from the group consisting of calcium chloride, strontium chloride, barium chloride and mixtures of the foregoing.

5. A process according to claim 1 wherein the surface is coated with a secondary coating selected from the group consisting of silicates, lacquers, and combinations of the foregoing, subsequent to contacting the surface with the composition.

6. A process according to claim 2 wherein the composition also comprises an organic acid.

7. A process according to claim 2 wherein the Group II metal compound is selected from the group consisting of calcium chloride, strontium chloride, barium chloride and mixtures of the foregoing.

8. A process according to claim 2 wherein the surface is coated with secondary coating selected from the group consisting of silicates, lacquers, and combinations of the foregoing, subsequent to contacting the surface with the composition.

9. A process according to claim 6 wherein the Group II metal compound is selected from the group consisting of calcium chloride, strontium chloride, barium chloride and mixtures of the foregoing.

10. A composition for improving the corrosion resistance of a surface comprising zinc or zinc alloys, said composition comprising:

a) a material selected from the group consisting of sources of titanium ions, titanates, and mixtures of the foregoing;

b) an oxidant selected from the group consisting of hydrogen peroxide, persulfates, nitrates and mixtures of the foregoing;

c) a complexing agent selected from the group consisting of fluorides, borofluorides, bifluorides, fluoroborates, fluorosilicates, and combinations of the foregoing; and d) a compound selected from the group consisting of Group II metal compounds;

wherein said composition is substantially free of silicates and silicon dioxide.

11. A composition according to claim 10 wherein the oxidant is hydrogen peroxide.

12. A composition according to claim 10 wherein the composition also comprises an organic acid.

13. A composition according to claim 10 wherein the Group II metal compound is selected from the group consisting of calcium chloride, strontium chloride, barium chloride and mixtures of the foregoing.

14. A composition according to claim 11 wherein the composition also comprises an organic acid.

15. A composition according to claim 11 wherein the Group II metal compound is selected from the group consisting of calcium chloride, strontium chloride, barium chloride and mixtures of the foregoing.

16. A composition according to claim 14 wherein the Group II metal compound is selected from the group consisting of calcium chloride, strontium chloride, barium chloride and mixtures of the foregoing.

17. A process for improving the corrosion resistance of a surface comprising zinc or zinc alloys, said process comprising contacting said surface with a composition comprising:

a) a material selected from the group consisting of sources of titanium ions, titanates, and mixtures of the foregoing;

b) an oxidant selected from the group consisting of hydrogen peroxide, persulfates, nitrates and mixtures of the foregoing;

c) a complexing agent selected from the group consisting of fluorides, borofluorides, bifluorides, fluoroborates, fluorosilicates, organic acids, and combinations of the foregoing; and d) a compound selected from the group consisting of Group II metal compounds;

wherein said composition is substantially free of silicates and silicon dioxide.

18. A process according to claim 17 wherein the oxidant is hydrogen peroxide.

* * * * *